US007302997B2

(12) United States Patent
Kozdras et al.

(10) Patent No.: US 7,302,997 B2
(45) Date of Patent: Dec. 4, 2007

(54) VIBRATION-RESISTANT MOUNTING BRACKET FOR HEAT EXCHANGERS

(75) Inventors: Mark S. Kozdras, Fergus (CA); Asad Max Kaspar, Fergus (CA); Doug Vanderwees, Mississauga (CA)

(73) Assignee: Dana Canada Corporation, Oakville, Ontario (CA)

( * ) Notice: Subject to any disclaimer, the term of this patent is extended or adjusted under 35 U.S.C. 154(b) by 0 days.

(21) Appl. No.: 10/851,785

(22) Filed: May 21, 2004

(65) Prior Publication Data

US 2005/0006052 A1 Jan. 13, 2005

(30) Foreign Application Priority Data

Jun. 27, 2003 (CA) ..... 2433697

(51) Int. Cl.
*F28D 1/02* (2006.01)

(52) U.S. Cl. ..... 165/67; 165/153; 165/166; 248/232; 248/231.81

(58) Field of Classification Search ..... 248/231.81, 248/213.3, 213.4, 232, 233, 234; 24/295; 165/67, 153, 166, 167, 68, 76, 149, 152, 165/140, 170, 175
See application file for complete search history.

(56) References Cited

U.S. PATENT DOCUMENTS

| | | | | |
|---|---|---|---|---|
| 1,246,325 | A | 11/1917 | Rohmer | |
| 3,113,615 | A | 12/1963 | Huggins | |
| 3,131,447 | A * | 5/1964 | Tinnerman | 248/231.81 |
| 4,196,774 | A | 4/1980 | Hoffmann | |
| 4,258,785 | A | 3/1981 | Beldam | |
| 4,402,118 | A * | 9/1983 | Benedetti | 24/289 |
| 4,569,390 | A | 2/1986 | Knowlton et al. | |
| 4,938,284 | A | 7/1990 | Howells | |
| 5,058,662 | A | 10/1991 | Nguyen | |
| 5,069,275 | A | 12/1991 | Suzuki et al. | |
| 5,086,832 | A | 2/1992 | Kadle et al. | |
| 5,107,926 | A | 4/1992 | Calleson | |
| 5,183,103 | A | 2/1993 | Tokutake | |
| 5,205,349 | A | 4/1993 | Nagao et al. | |
| 5,241,727 | A * | 9/1993 | Lee | 24/453 |
| 5,407,161 | A * | 4/1995 | Mulkeran | 248/232 |
| 5,429,182 | A * | 7/1995 | Hanafusa | 165/67 |

(Continued)

FOREIGN PATENT DOCUMENTS

CA 2405275 3/2003

(Continued)

OTHER PUBLICATIONS

International Search Report for PCT/CA2005/000612 mailed Aug. 15, 2005.

*Primary Examiner*—Kimberly Wood
(74) *Attorney, Agent, or Firm*—Ridout & Maybee LLP

(57) ABSTRACT

A mounting bracket is shown for a heat exchanger core having spaced-apart tubes having peripheral flanges surrounding a manifold. The mounting bracket has a first clip grooved to receive a front edge portion of a selected flange, and a pair of second clips, each grooved to receive, respectively, the back edge portion of an other flange disposed above the selected flange, and a further flange disposed below the selected flange. The clips are joined together by a panel portion adapted for the mounting of the heat exchanger. The clips are tapered to distribute bending stresses therealong.

20 Claims, 9 Drawing Sheets

U.S. PATENT DOCUMENTS

| | | | | |
|---|---|---|---|---|
| 5,487,422 | A | 1/1996 | Bertva et al. | |
| 5,535,819 | A * | 7/1996 | Matsuura | 165/149 |
| 5,570,737 | A | 11/1996 | Tokutake | |
| 5,692,559 | A | 12/1997 | Cheong | |
| 5,720,341 | A | 2/1998 | Watanabe et al. | |
| 5,759,004 | A * | 6/1998 | Kuffel | 411/508 |
| 5,791,402 | A | 8/1998 | Dumetz | |
| 5,871,189 | A * | 2/1999 | Hoftman | 248/229.16 |
| 5,879,101 | A * | 3/1999 | Hagura | 403/326 |
| 5,899,263 | A * | 5/1999 | Tokutake | 165/67 |
| 5,947,196 | A | 9/1999 | Halm et al. | |
| 5,964,282 | A | 10/1999 | Seiler et al. | |
| 6,000,460 | A | 12/1999 | Yamanaka et al. | |
| 6,199,622 | B1 | 3/2001 | Mashio et al. | |
| 6,237,676 | B1 | 5/2001 | Hasegawa et al. | |
| 6,263,954 | B1 | 7/2001 | Nakayama | |
| 6,276,445 | B1 | 8/2001 | Sasano et al. | |
| 6,405,788 | B1 | 6/2002 | Balthazard | |
| 6,530,424 | B2 | 3/2003 | Jamison et al. | |
| 6,665,914 | B2 * | 12/2003 | Ogawa | 24/297 |
| 6,742,572 | B2 * | 6/2004 | Muhammad et al. | 165/67 |
| 6,901,992 | B2 * | 6/2005 | Kent et al. | 165/67 |
| 2002/0056541 | A1 | 5/2002 | Kokubunji et al. | |
| 2003/0146030 | A1 | 8/2003 | Harada | |
| 2004/0261973 | A1 * | 12/2004 | Kent et al. | 165/67 |

FOREIGN PATENT DOCUMENTS

| | | |
|---|---|---|
| CA | 2069783 | 7/2003 |
| DE | 3215 961 | 11/1983 |
| DE | 4232019 | 10/1993 |
| EP | 1496270 | 1/2005 |
| FR | 2527325 | 11/1983 |
| FR | 2550618 | 2/1985 |
| FR | 2748559 | 11/1997 |
| JP | 3-164694 | 7/1991 |
| JP | 4288484 | 10/1992 |
| JP | 04288486 | 10/1992 |
| JP | 08159686 | 6/1996 |
| JP | 2002168589 | 6/2002 |

* cited by examiner

20

VIBRATION-RESISTANT MOUNTING BRACKET FOR HEAT EXCHANGERS

This application claims priority from Canadian Patent Application No. 2,433,697 filed on Jun. 27, 2003.

FIELD OF THE INVENTION

The present invention relates to the field of heat exchangers, and more particularly, to mounting brackets for heat exchanger cores.

BACKGROUND OF THE INVENTION

Heat exchanger cores are commonly formed from a plurality of thin, substantially flat tubes, stacked upon one another in spaced relation, which extend between a pair of spaced-apart manifolds. The manifolds are often simply constructed from pipe, suitably perforated to receive the flat tubes. Exemplary of this construction is the heat exchanger described in U.S. Pat. No. 5,183,103 (Tokutake), issued Feb. 2, 1993.

For the purpose of mounting, i.e., within the engine compartment of a vehicle or the like, heat exchanger cores of the type comprising perforated pipe manifolds, it is known to braze a mounting bracket to the manifold. The mounting bracket usually includes a tab or flange adapted to be secured to the vehicle frame. Usually, the mounting bracket is provided with a portion which is capable of resiliently engaging the exterior of the manifold to keep the mounting bracket in place during the brazing process, so as to avoid the need for auxiliary clamping tools, which can add to cost and can absorb heat in a brazing oven, resulting in poor quality brazed joints. The mounting brackets taught in U.S. Pat. No. 5,069,275 (Suzuki et al.), issued Dec. 3, 1991, are exemplary of this construction.

A difficulty with the pipe manifold type of heat exchanger cores, however, is that the pipe manifolds have to be made quite strong to support the mounting brackets, so this makes them heavy and expensive to manufacture.

Another type of heat exchanger cores uses plate pairs to define the heat exchanger passages. The plates are formed of back-to-back dish-shaped plates, each plate having a central portion, a pair of spaced-apart bosses and a peripheral flange. The plates thus disposed in pairs have the peripheral flanges of each plate in the pair connected to one another to form a fluid passage between the central portions, and the plate pairs are disposed in stacked relation, with the bosses in adjacent pairs having through holes therein, so that when the bosses are joined to one another, they form a manifold to permit the flow of fluid through the pairs. Exemplary of this construction is the heat exchanger core described in U.S. Pat. No. 5,964,282 (Seiler et al.), issued Oct. 12, 1999.

Characteristic of the plate pair type of heat exchanger cores used in the past is that special heavier gauge plates are usually required to be joined to the fluid carrying plate pairs in order to permit suitable mounting brackets to be attached to the cores. This again increases the number of components required and thus the cost of the heat exchangers.

SUMMARY OF THE INVENTION

In the present invention, a mounting bracket is provided for a heat exchanger core having tubular or plate pair heat exchanger passages, where the tubes or plate pairs have peripheral edges or flanges adjacent to the manifolds. The mounting bracket attaches directly to the peripheral edges or flanges, giving maximum flexibility as to the location of the mounting brackets.

According to the invention, there is provided a mounting bracket for a heat exchange core of the type having a tubular manifold disposed about a primary axis. The manifold is formed with a plurality of tubular manifold segments and has top and bottom ends spaced apart in the direction of a primary axis. Inner and outer sides of the manifold are spaced apart in the direction of a secondary axis perpendicular to the primary axis. Front and back sides of the manifold are spaced apart in the direction of a tertiary axis perpendicular to the primary and secondary axes. A plurality of fluid tubes are arranged in substantially parallel, spaced-apart relation. Each tube extends inwardly from a respective manifold segment and extends therefrom substantially parallel to the secondary axis. Each tube has a respective peripheral flange with front and rear portions adjacent to the respective front and back sides of each respective manifold segment. Each flange has a pair of laterally extending front and back edge portions spaced-apart from one another in the direction of the tertiary axis. The mounting bracket comprises a first clip portion having a respective elongate groove formed therein adapted to receive the front edge portion of a selected flange. A pair of second clip portions each has a respective elongate groove formed therein. The second clip portions are adapted to receive, respectively, the back edge portion of an other of the flanges disposed above the selected flange, and the back edge portion of a further of the flanges disposed below selected flange. The second clip portions are rigidly connected to the first clip portion to grip, in combination therewith, the core.

Preferably, the first clip portion is shaped and dimensioned such that the effective depth of the elongate groove therein decreases, most preferably to nil, as the first clip portion extends laterally inwardly.

Preferably, each of the second clip portions is shaped and dimensioned such that the effective depth of the elongate grooves therein decreases, most preferably to nil, as the second clip portions extend laterally inwardly.

Preferably, the other flange is adjacent to the selected flange and the further flange is longitudinally adjacent to the selected flange.

Preferably, the mounting bracket further comprises a mounting panel portion rigidly connected to the first clip portion and adapted to be secured to a vehicle frame, in use.

Preferably, the mounting panel portion projects laterally beyond the outer edge of the selected flange in use.

Preferably, the first clip portion and the panel portion together define an elongate bridge structure, each defining one end thereof, and the elongate groove of the first clip portion runs longitudinally relative to the bridge structure, and terminates at the end defined by the first clip portion.

The pair of second clip portions are preferably rigidly connected to the first clip portion by a pair of leg portions, disposed in spaced-apart relation to one another, each leg portion rigidly extending between the bridge structure and a respective second clip portion.

The leg portions are preferably substantially planar, are orientated substantially parallel to one another, and have contacting parts which are disposed, in use, in overlapping relation, respectively, against the bottom or top surface of the other flange and against the top or bottom surface of the further flange.

The second clip portions each preferably extend generally the length of the bridge structure and slightly beyond the first clip portion thereof.

The mounting bracket preferably further comprises a pair of abutment ear portions extending away from one another, each from a respective leg portion and in substantially transverse relation thereto, and abutting, in use, respectively, the outer edges of each of the other and further flanges.

In use, the second clip portions preferably extend laterally, inwardly, beyond the lateral extent of the manifold and the first clip portion terminates adjacent to the mid point of the manifold.

BRIEF DESCRIPTION OF THE DRAWINGS

In the accompanying drawings, which are for the purpose of illustration and description only, and are not intended as a definition of the limits of the invention.

DESCRIPTION OF THE PREFERRED EMBODIMENTS

Figures 1, 2, 3, 4, 5, 6, 7:
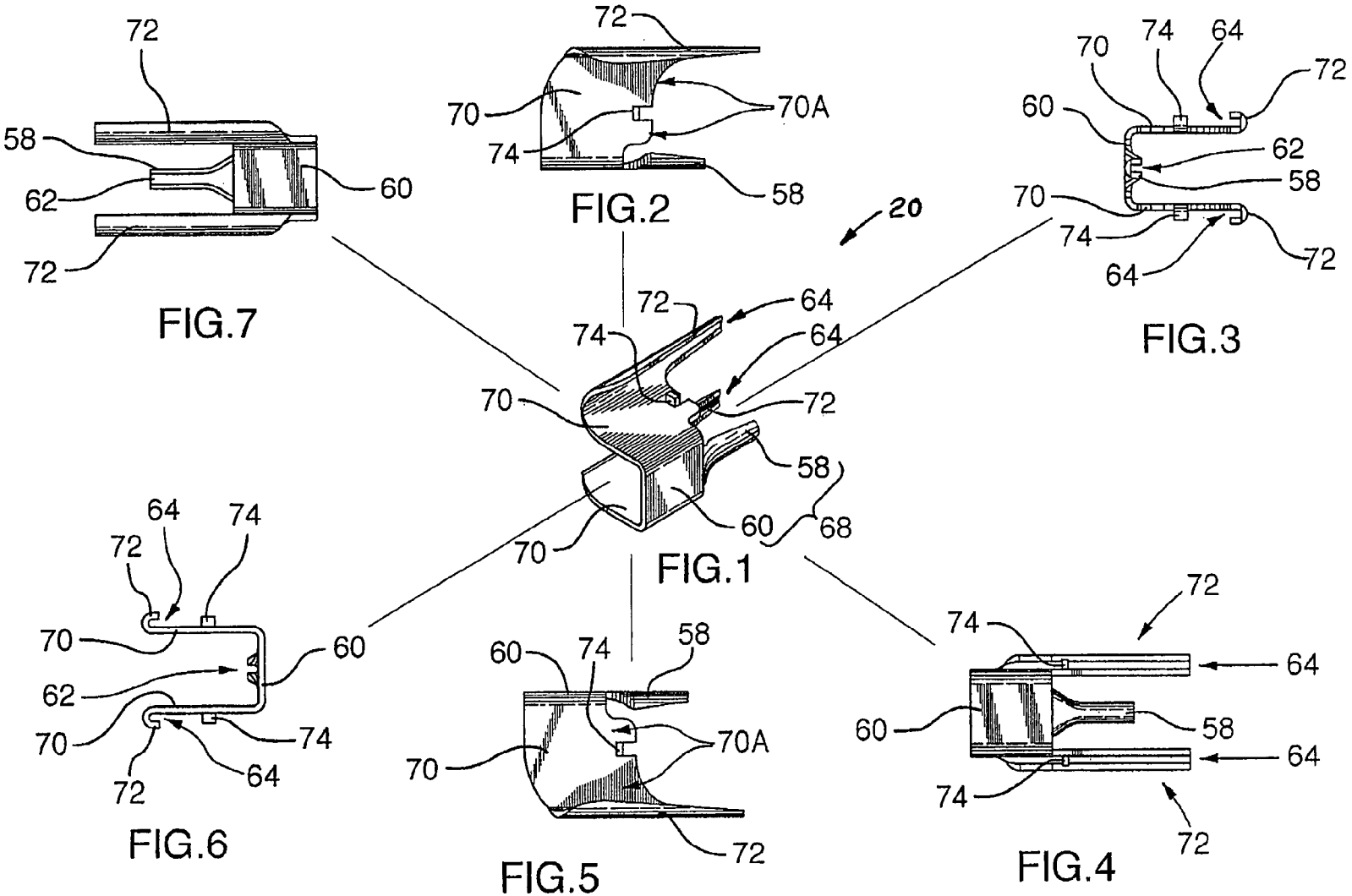
FIG. 1 is a perspective view of a mounting bracket according to a preferred embodiment of the present invention.
FIG. 2 is a top plan view of the mounting bracket of FIG. 1.
FIG. 3 is a right side elevational view of the mounting bracket of FIG. 1.
FIG. 4 is a front elevational view of the mounting bracket of FIG. 1.
FIG. 5 is a bottom view of the mounting bracket of FIG. 1.
FIG. 6 is a left side elevational view of the mounting bracket of FIG. 1.
FIG. 7 is a rear elevational view of the mounting bracket of FIG. 1.

A mounting bracket according to a preferred embodiment of the present invention is illustrated, inter alia, in FIG. 1 through FIG. 8, and is designated with general reference numeral 20.

The mounting bracket 20 will be described with particularity in the following paragraphs.

However, for greater clarity in the following description, a heat exchanger core, which does not form part of the invention, but rather, is for use with which the mounting bracket 20, will be firstly described with general reference to FIG. 9, wherein it is designated with general reference numeral 22.

In this regard, the heat exchanger core 22, only a part of which is shown for ease of illustration, includes a manifold 24 having a primary axis X-X.

The primary axis X-X is a longitudinal axis for manifold 24. Core 22 also has a secondary or lateral axis Y-Y arranged substantially transverse to the primary axis X-X to intersect same. A plurality of fluid tubes 26 extend parallel to lateral axis Y-Y. Tubes 26 are formed of plate pairs and thus have joined peripheral flanges 28.

Core 22 also has a tertiary axis Z-Z arranged substantially transverse to and intersecting each of the primary and secondary axes X-X and Y-Y.

The manifold 24 is formed by mating, communicating end bosses formed in the plate pairs, and thus is generally tubular in configuration having front side 44 and a back side 46 and an inner side 40 and an outer side 42. The outer surface 34 can be considered as having a plurality of grooves 36 formed therein between the joined peripheral flanges of the plate pairs. The grooves 36 are substantially uniformly longitudinally spaced-apart from one another and each is concentric with the primary axis X-X. The manifold 24 is thus divided into a plurality of tubular manifold segments 38. The top and bottom ends 30, 32 are spaced apart from one another in the direction of the primary axis X-X. The front and back manifold sides 44, 46 are spaced apart from one another in the direction of the tertiary axis Z-Z. The inner and outer manifold sides 40, 42 are spaced apart from one another in the direction of the secondary axis Y-Y.

The plurality of fluid tubes 26 are arranged in substantially parallel, spaced-apart relation. Each tube 26 is associated with a respective manifold segment 38 and extends inwardly from the inner side 40 of one manifold 24 to another manifold 24 (not shown) at the opposite end of heat exchanger core 22. The tubes 26 are substantially parallel to the secondary axis Y-Y.

Figure 9:
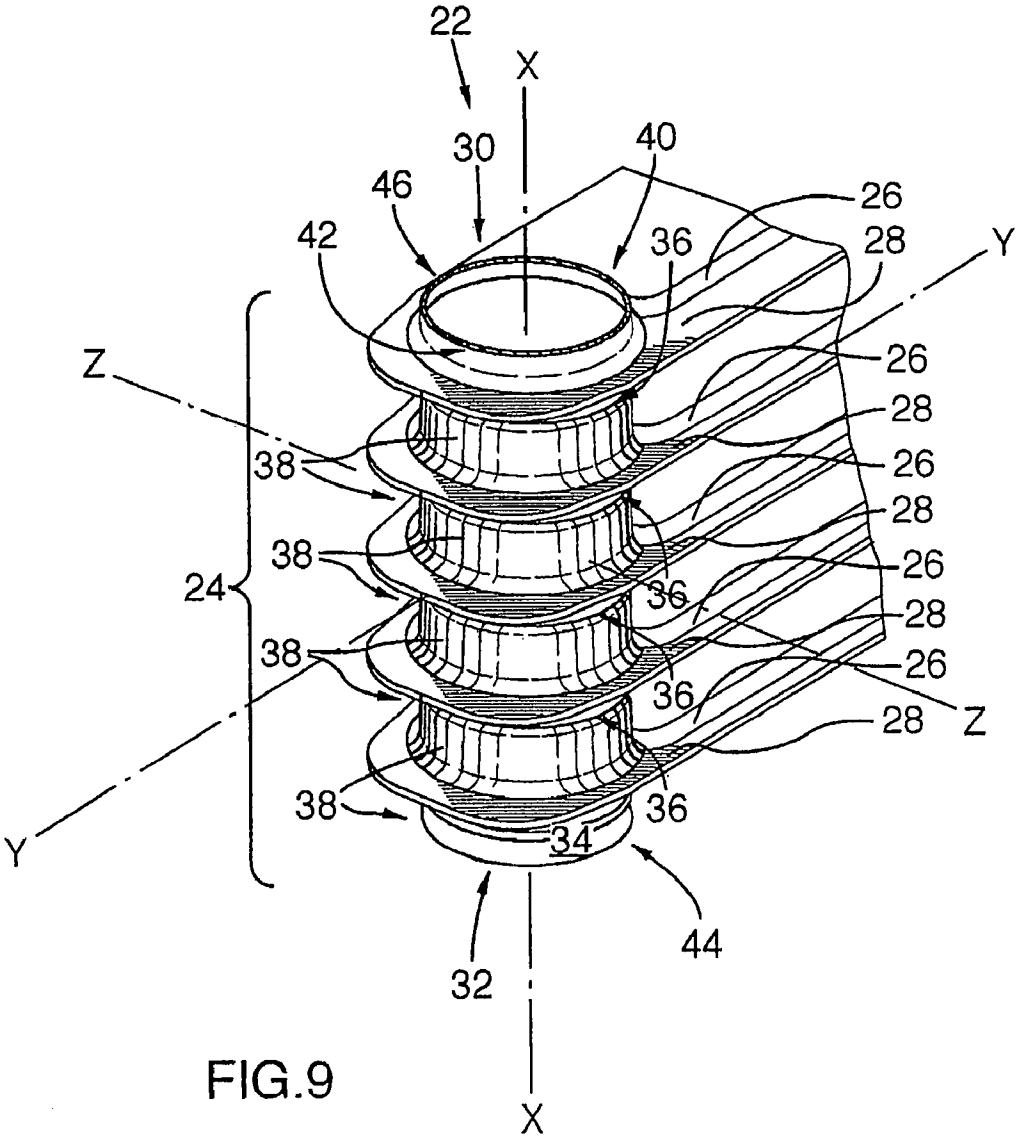
FIG. 9 is an exploded view of the mounting bracket of FIG. 1, shown at a position laterally outwardly from a heat exchanger core, only a portion of which is shown.
Figure 9:
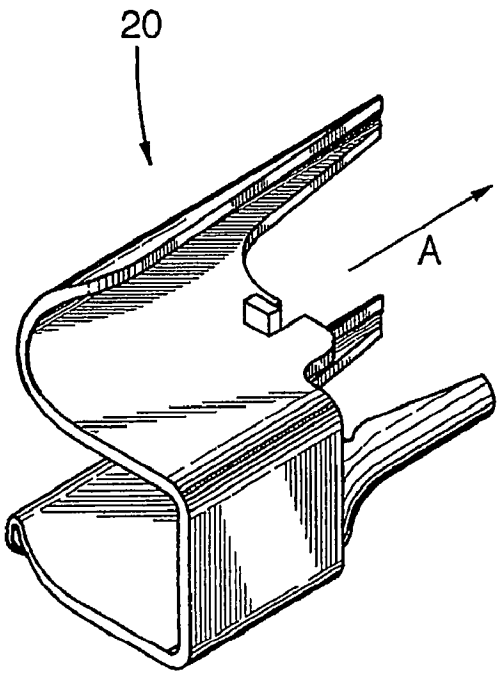
Figure 10:
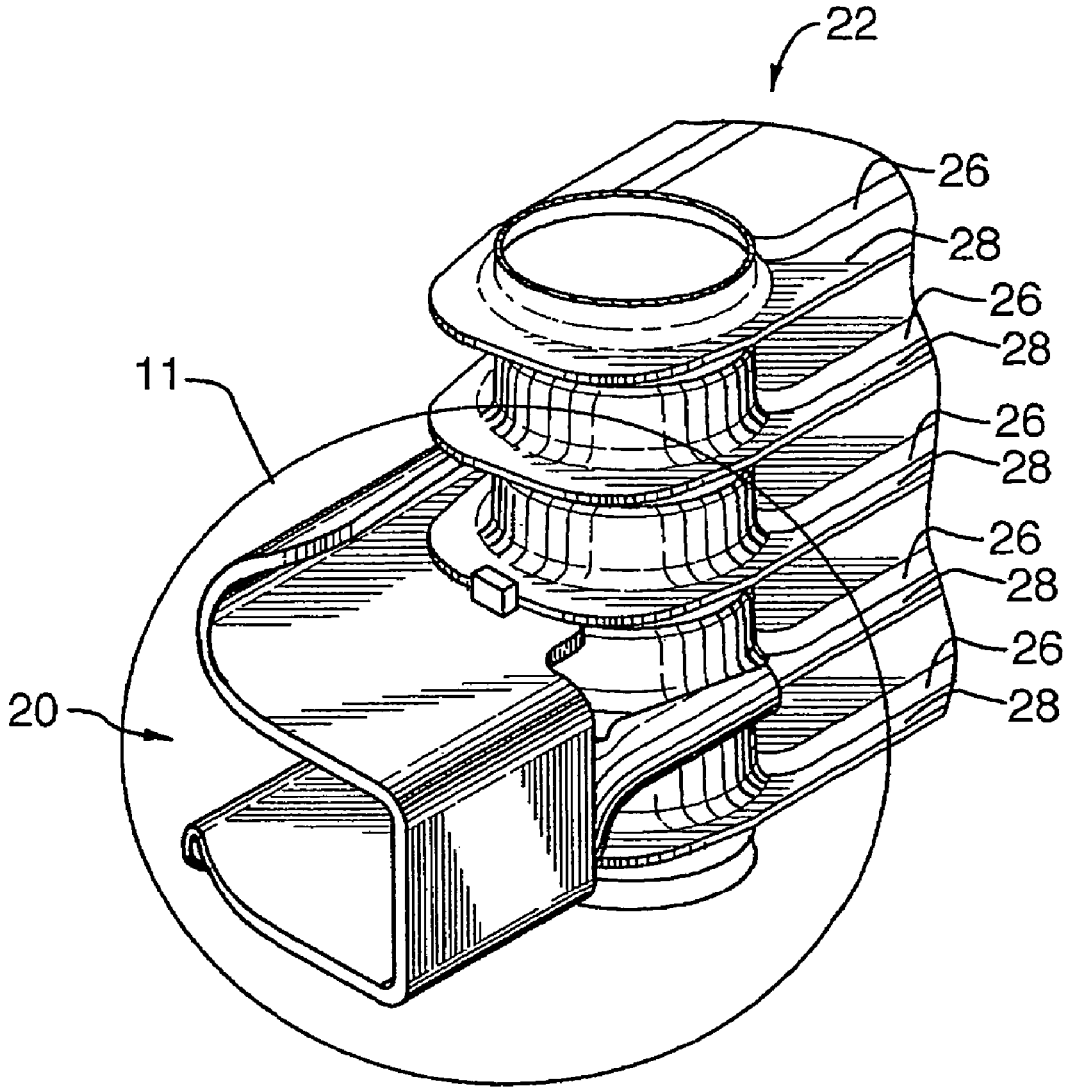
FIG. 10 is a view similar to FIG. 9, with the mounting bracket shown in use with the heat exchanger core.
Figure 11:
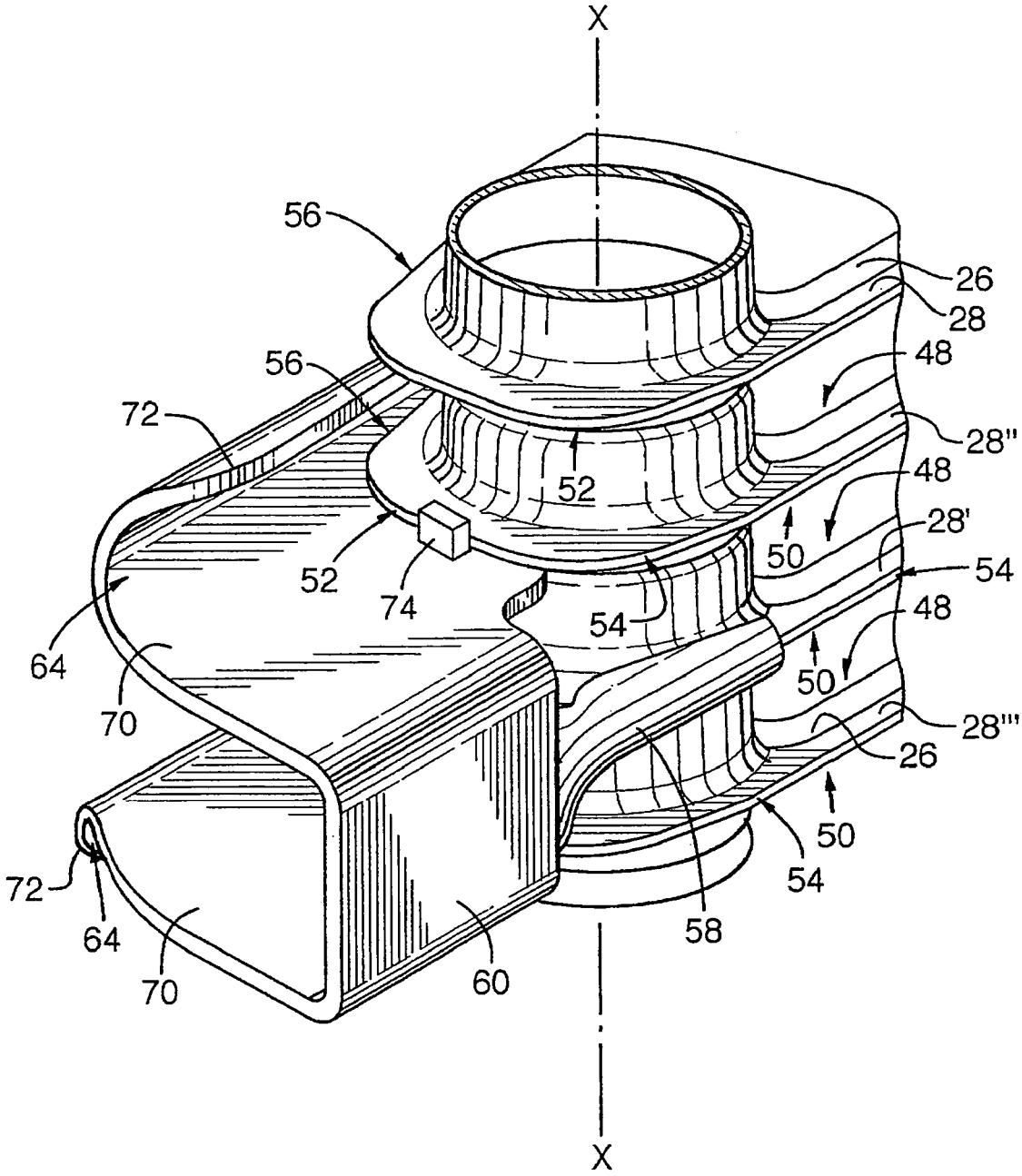
FIG. 11 is an enlarged view of encircled area 11 in FIG. 10.

With general reference to FIGS. 9-11, each flange 28 extends radially, with respect to the primary axis X-X, from its respective manifold segment 38. Further, each flange 28 at least partially surrounds its manifold segment 38. Each flange 28 has a top surface 48 and a bottom surface 50 and is circumscribed by an outer edge portion 52, disposed laterally outwardly from the manifold 24, and by a pair of laterally-extending front and back edge portions 54, 56 spaced-apart from one another in the direction of the tertiary axis Z-Z.

Figure 8:
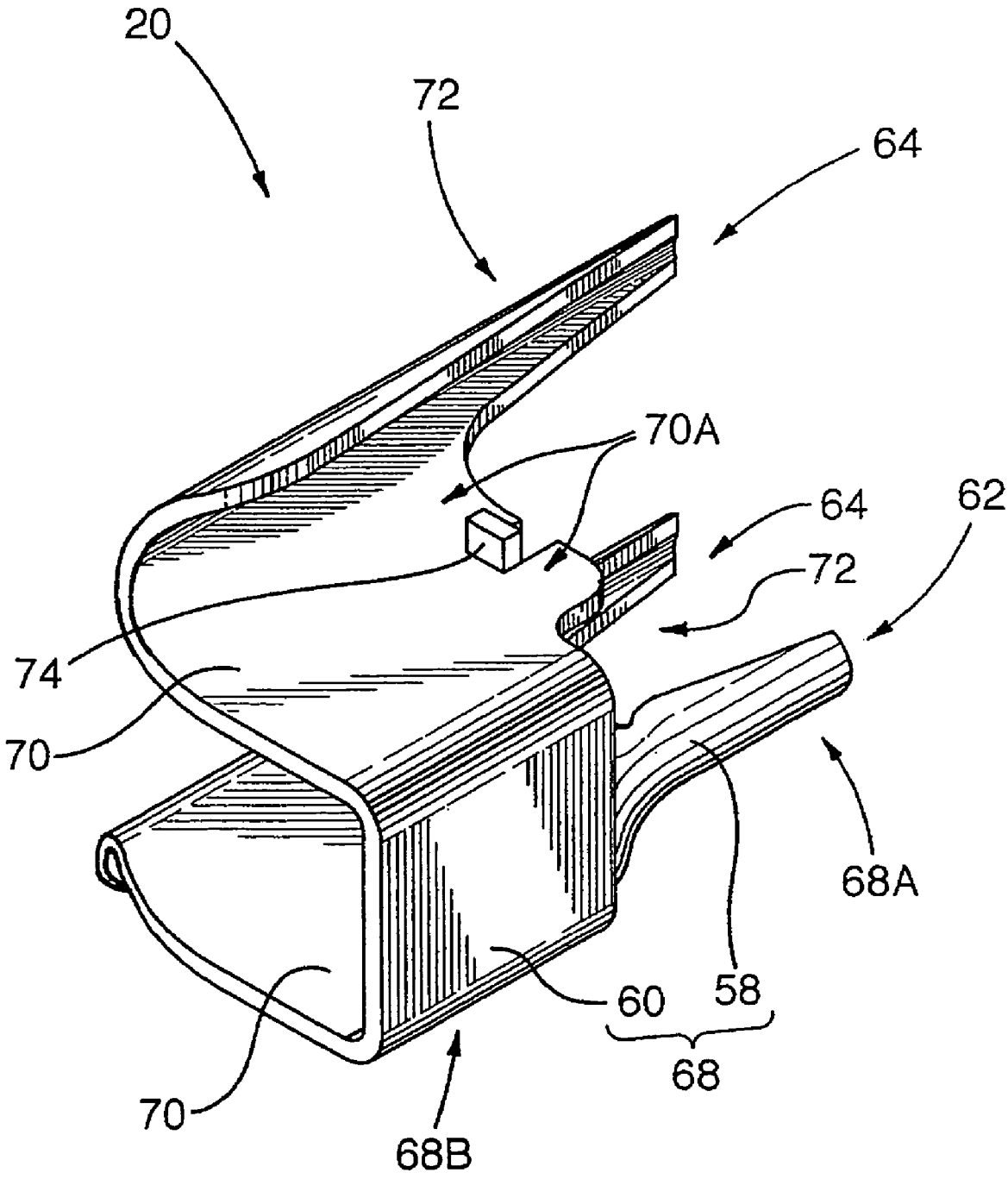
FIG. 8 is an enlarged perspective view of the mounting bracket of FIG. 1.

Against this background, the mounting bracket 20 of the preferred embodiment will now be described and should be understood to comprise a first clip portion 58 and a mounting panel or lug portion 60, as illustrated, inter alia, in FIG. 8.

The first clip portion 58 has an elongate groove 62 (see FIG. 3) formed therein.

The mounting panel portion 60 is rigidly connected to the first clip portion 58 in a manner such that first clip portion 58 and panel portion 60 together define an elongate bridge structure 68 having opposite ends 68A, 68B. The elongate groove 62 of the first clip portion 58 runs longitudinally relative to the bridge structure 68, and terminates at the end 68A thereof defined by the first clip portion 58.

The mounting bracket 20 further comprises a pair of second clip portions 72 and a pair of leg portions 70.

Each of the second clip portions 72 has a respective elongate groove 64 formed therein, and extends longitudinally slightly beyond the first clip portion 58 thereof, as best illustrated in FIGS. 2 and 4.

The leg portions 70 each extend between the bridge structure 68 and a respective second clip portion 72, thereby to connect the second clip portions 72 and the first clip portion 58, and will be seen to be substantially planar, disposed in spaced-apart, substantially parallel relation to one another, and to have respective edge areas 70A.

Also provided is a pair of abutment ear portions 74, extending away from one another, each from a respective leg portion 70 and in substantially transverse relation thereto.

In the preferred embodiment, the mounting bracket 20 is intended to be permanently connected to the heat exchanger core 22 by brazing. As such, mounting bracket 20 is constructed out of a suitable brazing material, specifically, brazing-clad aluminum, suitably stamped and formed into shape, so that close-fitting, abutting and overlapping structures on the mounting bracket 20 and heat exchanger core 22 will be brazed together, preferably in the same process by which the heat exchanger core 22 is brazed in a furnace brazing process. Mounting bracket 20 can be made of other metals however, and suitably joined to core 22. The configuration of brazing-clad aluminum, and the manner in which the various structural features of the mounting bracket 20 of the preferred embodiment may be formed are well known to persons of ordinary skill in the art, and as such, not detailed herein.

In use, the mounting bracket 20 is positioned against the heat exchanger core 22 at an assembly position, shown in FIG. 10 through FIG. 15, by positioning the mounting bracket 20 laterally outwardly from the core 22, as shown in FIG. 9, and urging same in the direction of arrow A thereof.

Figure 12:
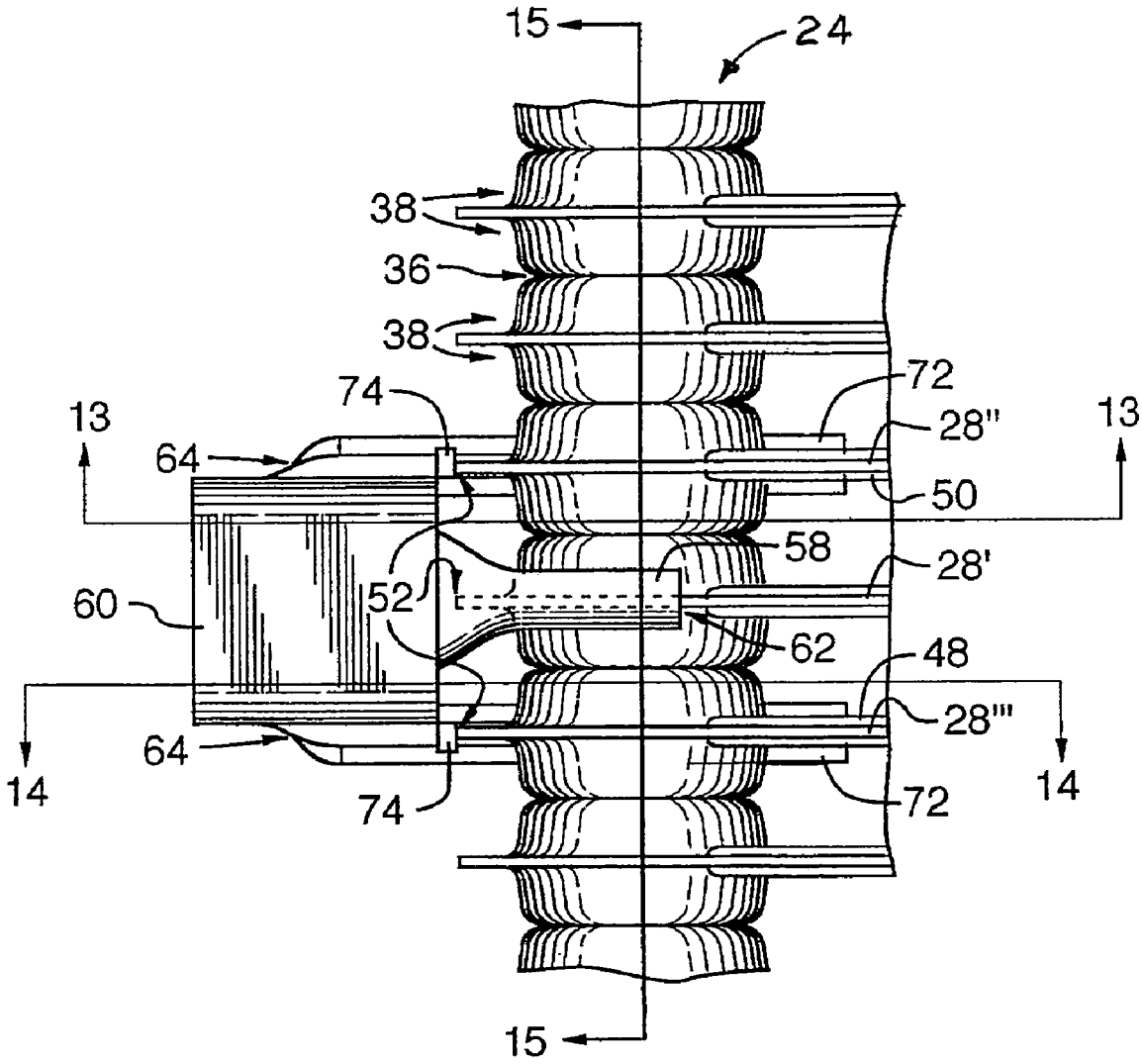
FIG. 12 is a front elevational view of the structure of FIG. 11.
Figure 15:
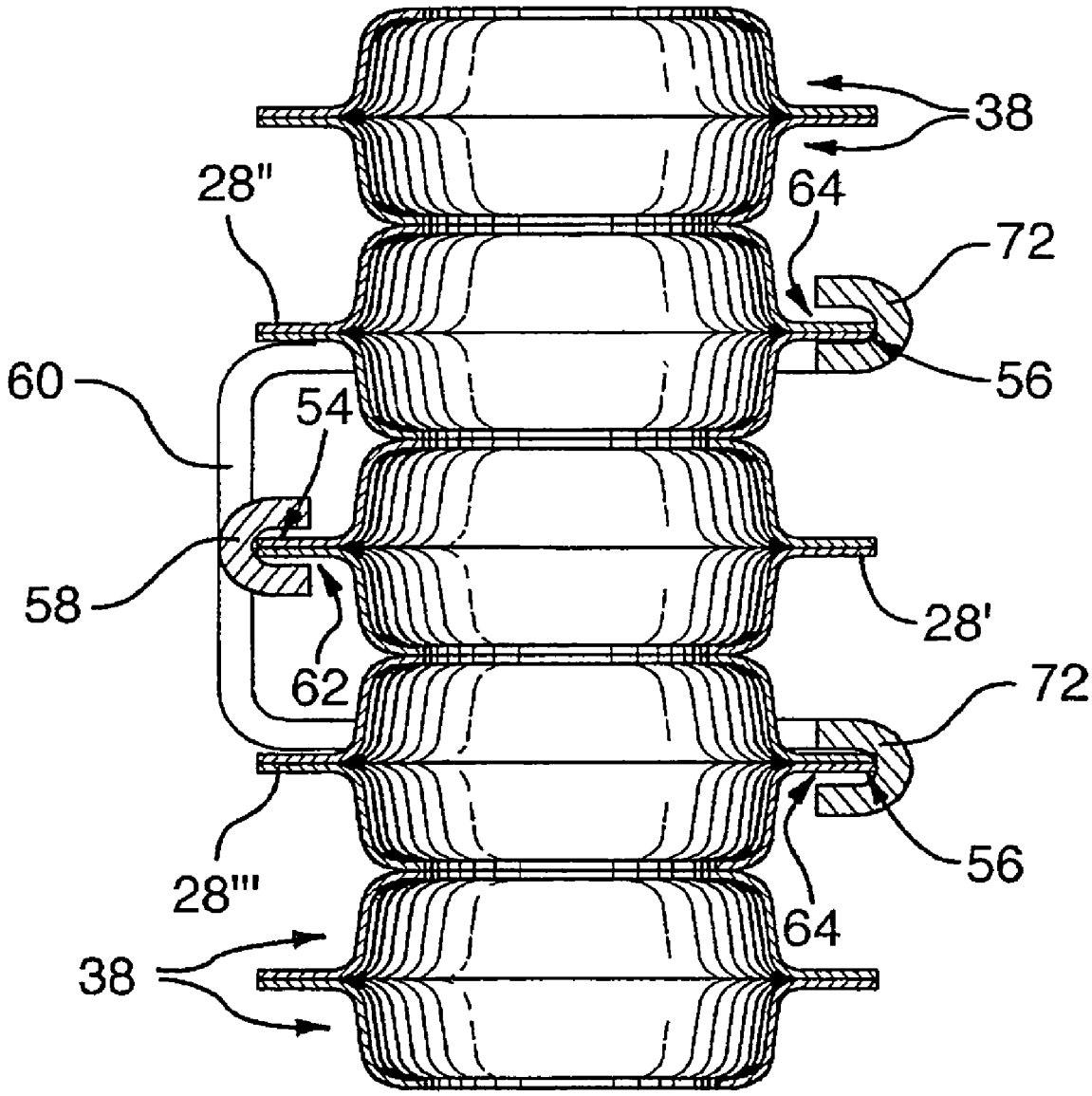
FIG. 15 is a view taken along section lines 15-15 of FIG. 12.

At the assembly position of mounting bracket 20 as seen in FIG. 11, the second clip portions 72 extend laterally, inwardly, slightly beyond manifold 24, and the first clip portion 58 terminates proximate the lateral midpoint of manifold 24 as indicated in FIG. 12. The elongate groove 62 of the first clip portion 58 is in close-fitting receipt of a selected flange 28', as shown in FIG. 15. It will be evident that the groove 62 thus defines means for mechanically engaging, in use, the selected flange 28'. It is notable, for reasons discussed below, that the first clip portion 58 is tapered or shaped and dimensioned such that the effective depth of the elongate groove 62 decreases to nil as the first clip portion 58 extends laterally inwardly, as best indicated in FIGS. 2 and 5.

The elongate grooves 64 of the second clip portions 72 are in close-fitting receipt, respectively, of an other flange 28" disposed, with respect to the selected flange 28', above or relatively proximal to the top end 30 of manifold 24, and of a further flange 28'" disposed, with respect to the selected flange 28', below or relatively distal to the top end of the manifold 24, as illustrated in FIGS. 11, 13, 14, 15. Thus, grooves 64 of the second clip portions 72 define means for mechanically engaging, respectively, each of the other flange 28" and the further flange 28'".

It is notable, again for reasons discussed in following paragraphs, that each of the second clip portions 72 is tapered or shaped and dimensioned such that the effective depth of the elongate groove 64 therein decreases to nil as the second clip portions 72 extend laterally inwardly.

Figure 13:
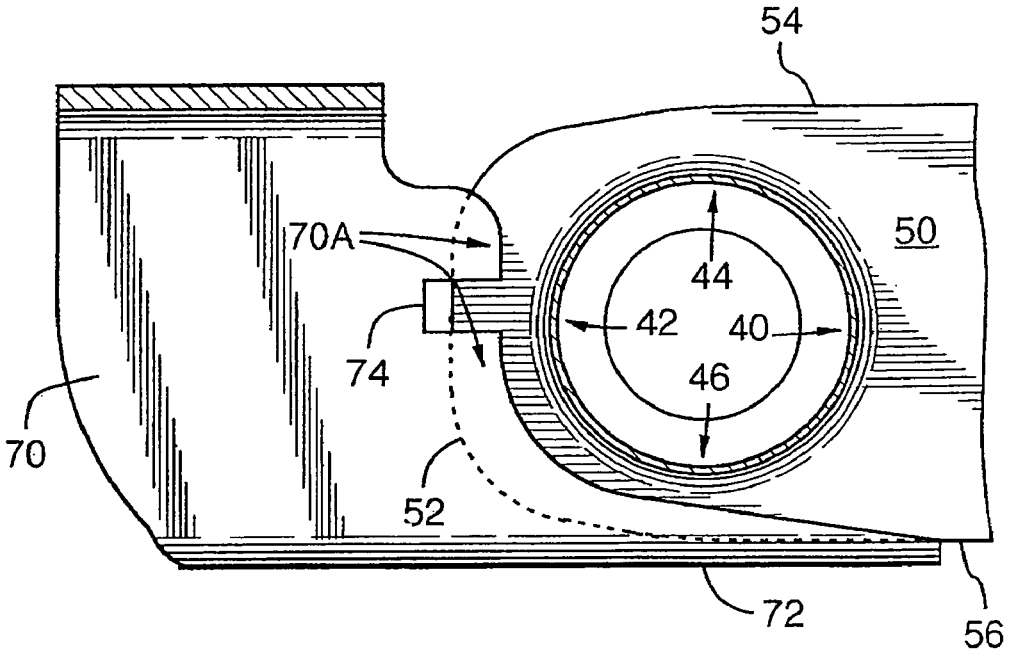
FIG. 13 is a view taken along section lines 13-13 of FIG. 12.
Figure 14:
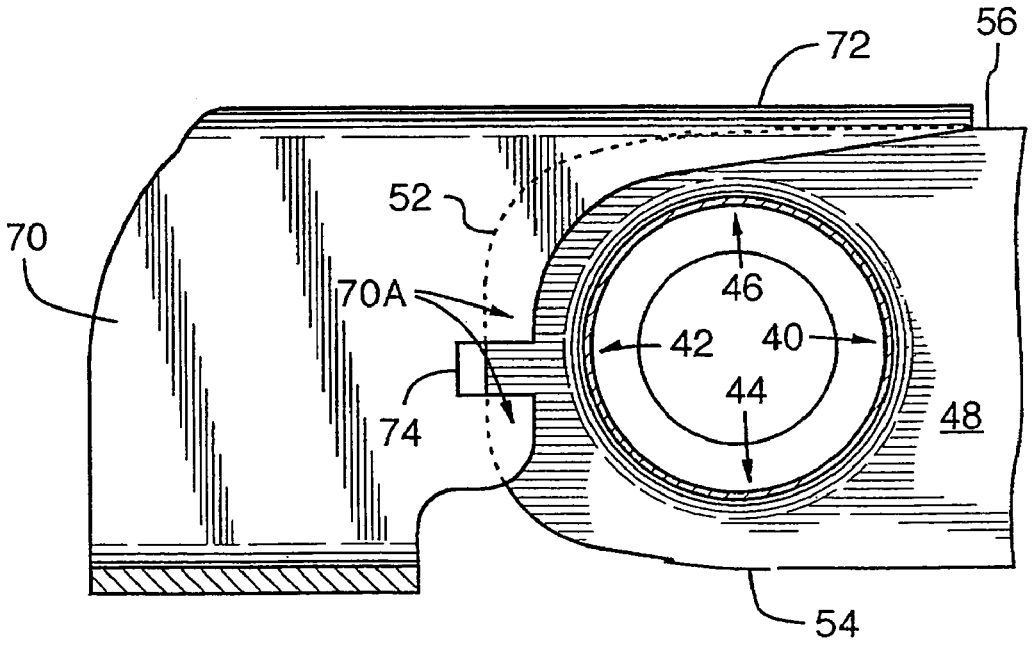
FIG. 14 is a view taken along section lines 14-14 of FIG. 12.

The contacting parts 70A (see FIG. 8) are disposed, in overlapping relation, respectively, against the bottom surface 50 of the other flange 28" and against the top surface 48 of the further flange 28'", as indicated in FIGS. 13, 14, wherein the flanges 28", 28'" are delineated in chain-dotted lines. The abutment ear portions 74 engage respectively, the outer edges or edge portions 52 of each of the other flange 28" and the further flange 28'", as indicated in FIGS. 11, 12. The mounting panel portion 60 projects laterally beyond the outer edge 52 of the selected flange 28', as indicated in FIG. 12, wherein the selected flange 28' is shown in chain-dotted outline, thereby to facilitate mounting of the heat exchanger core 22.

In such assembly position, the mounting bracket 20 grippingly engages the core 22 with sufficient tenacity so as to permit subsequent permanent connection therebetween by conventional techniques such as brazing, soldering, welding, adhesives or the like, without the need for auxiliary clamps. This is advantageous, since auxiliary clamps can add to cost and, in the context of brazing, can absorb heat, resulting in poor quality brazed joints.

It will be evident that after such permanent connection has been completed, the mounting bracket 20 and the heat exchanger core 22 will form an integral unit suitable for mounting to a vehicle frame (not shown). Consequently, motion of the vehicle may cause vibration of the heat exchanger core 20 with respect to the vehicle frame. The aforementioned tapering of the first clip portion 58 and second clip portions 72 distributes and absorbs any transverse stresses on the heat exchanger core to reduce the likelihood of cracking of the core.

Figure 16:
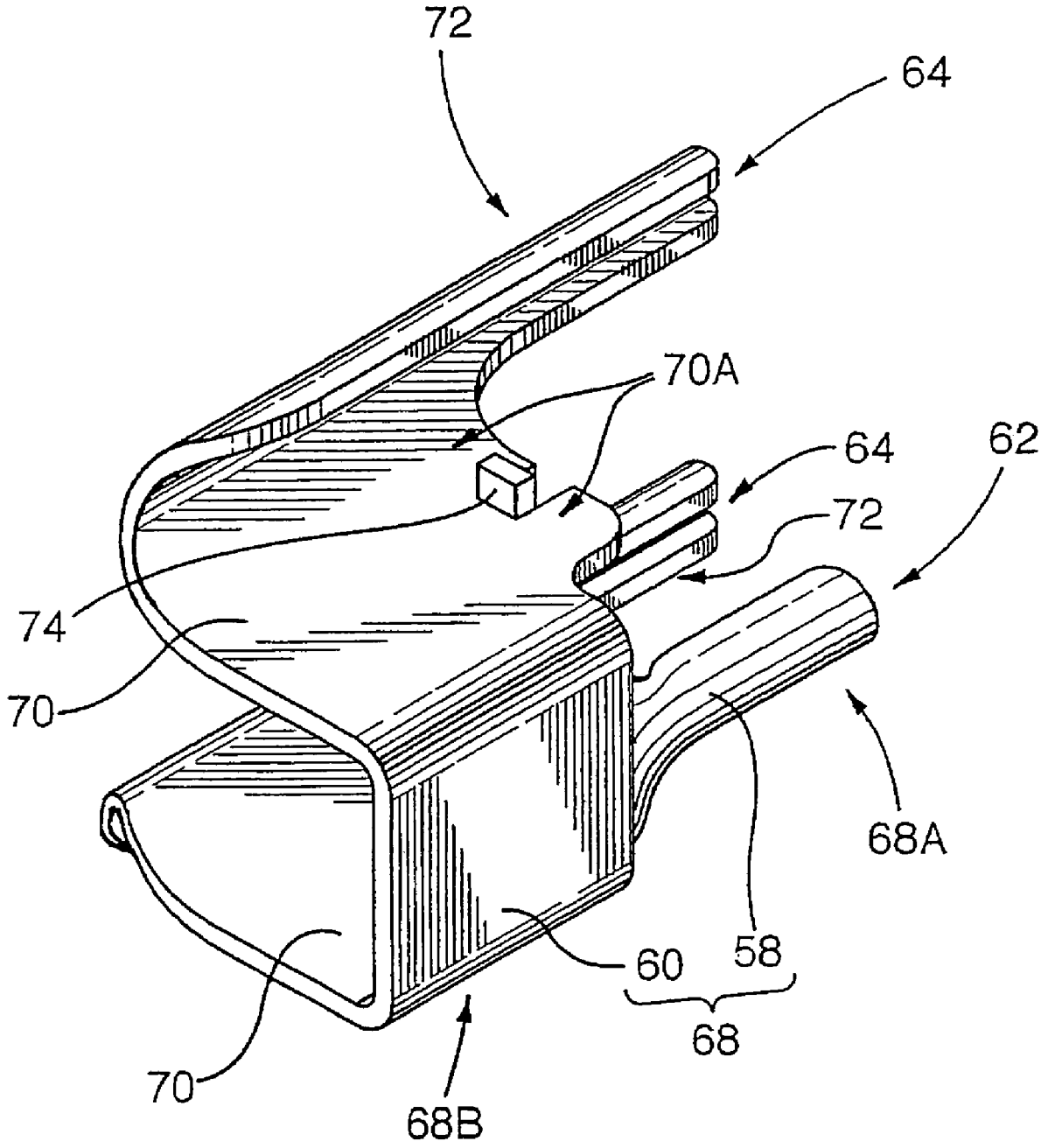
FIG. 16 is a perspective view similar to FIG. 8, but showing another preferred embodiment of the subject invention.

However, the tapering of first and second clip portions 58 and 72 is not essential. FIG. 16 shows another preferred embodiment where clip portion 58' and 72' are not tapered. Otherwise the mounting bracket of FIG. 16 is the same as the brackets shown in FIGS. 1 to 15.

Having described preferred embodiments of the mounting bracket of the present invention, it will be evident that various modifications and alterations can be made to the structure as described.

For example, whereas in the preferred embodiments illustrated, the mounting bracket engages the flanges of three contiguous manifold segments, to wit, the selected flange 28', the other flange 28" which is longitudinally adjacent to the selected flange 28' and the further flange 28'" which is longitudinally adjacent to the selected flange 28', the mounting bracket could of course be readily resized, such that it spans more flanges or few flanges, if desired (not shown). Further, mounting bracket 20 could be made a bit wider than shown, so that edge areas 70A engage the top and bottom surfaces of the respective flanges 28" and 28'", or both bottom surfaces or both top surfaces. In these instances, ear portions 74 could be orientated differently, such as toward each other or in the same direction, as long as at least one of them abuts flange edge portion 52.

As well, whereas in the preferred embodiment the first clip portion and second clip portions are elongate structures of substantially U-shaped profile, it will be readily understood that such construction is not necessary; for example, the elongate grooves could be C-shaped. Clip portions 58 and 72 can be different lengths. The grooves in the clip portions could be formed in other ways, such as by using projections or flanges that grip the peripheral edges of the tubes of the heat exchanger core.

Moreover, whereas the preferred mounting bracket is constructed out of brazing clad aluminum, for reasons outlined previously, it will of course be evident that other metals or materials may be readily substituted therefor, and the invention is considered to encompass mounting brackets constructed from other materials.

Additionally, whereas in the illustrations, clearance is shown between the fluid tubes, it will be evident that the mounting bracket may be utilized with heat exchangers having fins or vanes disposed between the tubes.

The terms "tube" or "tubular" in the present specification is intended to include any configuration of hollow conduit, such as conduits having rectangular or hexagonal cross-sections, for example.

As well, whereas the abutment ear portions in the preferred embodiments abut the flange outer end portions in use, they could readily be omitted, and if desired, the positioning and functionality thereof could be easily assumed by the contacting parts that abut the manifold.

Of course, and without limitation, the mounting panel portion could be formed with an aperture shaped and dimensioned to receive a suitable mechanical fastener such as a nut and bolt assembly or rivet (not shown), to mount the heat exchanger core.

While the preferred embodiments show plate pair type heat exchanger cores, the mounting bracket of the present invention could be used with the heat exchanger cores having pipe manifolds and heat transfer tubes having peripheral edges or flanges adjacent to the front and back sides of the manifolds, or surrounding the manifolds.

Additionally, the mounting bracket may be utilized with heat exchangers having turbulizers, of expanded metal or the like, disposed Within the fluid tubes.

Further, whereas the mounting panel portion illustrated is substantially planar, and orientated substantially normal to the tertiary axis in use, it could be orientated in any other direction, even perpendicular to the tube sides (i.e. normal to the secondary axis) if desired, to suit a particular mounting configuration for the core.

Yet further, whereas the disclosure is directed primarily to the field of heat exchangers, the mounting bracket of the present invention may be used in association with other fluid handling devices of similar construction, for example, condensers, filtration devices, fuel cells and fuel reformers or processors.

As well, whereas the longitudinal axis defines a manifold top and bottom end which, in the preferred embodiments illustrated, are spaced apart from one another vertically, it will be evident that the manifold "top" need not be disposed upwardly from the manifold "bottom" and could, for example, be disposed horizontally therefrom, or even downwardly therefrom.

From the foregoing, it will be evident to persons of ordinary skill in the art that the scope of the present invention is limited only by the accompanying claims, purposively construed.

The invention claimed is:

1. A mounting bracket for a heat exchanger core of the type having a tubular manifold disposed about a primary axis, said manifold being formed of a plurality of tubular manifold segments and having top and bottom ends spaced apart in the direction of the primary axis, inner and outer sides spaced apart in the direction of a secondary axis perpendicular to the primary axis, and front and back sides spaced apart in the direction of a tertiary axis perpendicular to the primary and secondary axes; a plurality of fluid tubes arranged in substantially parallel, spaced-apart relation, each tube extending inwardly from a respective manifold segment, and extending therefrom substantially parallel to the secondary axis; and each tube having a respective peripheral flange with front and rear portions adjacent to the respective front and back sides of each respective manifold segment, each flange having a pair of laterally extending front and back edge portions spaced-apart from one another in the direction of the tertiary axis;

said mounting bracket comprising:

a first clip portion having an elongate groove formed therein adapted to grippingly engage the front edge portion only of a selected flange;

a mounting panel portion located adjacent to the first clip portion and together defining a bridge structure;

a pair of second clip portions each having a respective elongate groove formed therein, said second clip portions being adapted to grippingly engage, respectively, the back edge portion of an other one of the flanges disposed above the selected flange, and the back edge portion of a further one of the flanges disposed below the selected flange, the second clip portions being connected to the first clip portion to grip the core in a three-point contact configuration; and a pair of planar, parallel leg portions extending between the bridge structure and the second clip portions, so that when the leg portions are located perpendicular to the primary axis the leg portions extend from the mounting panel portion in the direction of the tertiary axis from said front edge portion of said selected flange to said back edge portions of said other one and said further one of said flanges.

2. A mounting bracket for a heat exchanger core of the type having a tubular manifold disposed about a primary axis, said manifold being formed of a plurality of tubular manifold segments and having top and bottom ends spaced apart in the direction of the primary axis, inner and outer sides spaced apart in the direction of a secondary axis perpendicular to the primary axis, and front and back sides spaced apart in the direction of a tertiary axis perpendicular to the primary and secondary axes; a plurality of fluid tubes arranged in substantially parallel, spaced-apart relation, each tube extending inwardly from a respective manifold segment, and extending therefrom substantially parallel to the secondary axis; and each tube having a respective peripheral flange with front and rear portions adjacent to the respective front and back sides of each respective manifold segment, each flange having a pair of laterally extending front and back edge portions spaced-apart from one another in the direction of the tertiary axis;

said mounting bracket comprising:

a first clip portion having an elongate, tapered groove formed therein adapted to grippingly engage the front edge portion of a selected flange, the first clip portion being shaped and dimensioned such that the effective depth of the elongate groove therein decreases in the longitudinal direction of the elongate groove; and a pair of second cup portions each having a respective elongate groove formed therein, said second clip portions, being adapted to grippingly engage, respectively, the back edge portion of an other one of the flanges disposed above the selected flange, and the back edge portion of a further one of the flanges disposed below the selected flange, the second clip portions being connected to the first clip portion to grip, in combination therewith, the core.

3. A mounting bracket for a heat exchanger core of the type having a tubular manifold disposed about a primary axis, said manifold being formed of a plurality of tubular manifold segments and having top and bottom ends spaced apart in the direction of the primary axis, inner and outer sides spaced apart in the direction of a secondary axis perpendicular to the primary axis, and front and back sides spaced apart in the direction of a tertiary axis perpendicular to the primary and secondary axes; a plurality of fluid tubes arranged in substantially parallel, spaced-apart relation, each tube extending inwardly from a respective manifold segment, and extending therefrom substantially parallel to the secondary axis; and each tube having a respective peripheral flange with front and rear portions adjacent to the respective front and back sides of each respective manifold segment, each flange having a pair of laterally extending front and back edge portions spaced-apart from one another in the direction of the tertiary axis;

said mounting bracket comprising:

a first clip portion having an elongate groove formed therein adapted to grippingly engage the front edge portion of a selected flange; and a pair of second clip portions each having a respective elongate tapered groove formed therein, said second clip portions, being adapted to grippingly engage, respectively, the back edge portion of an other one of the flanges disposed above the selected flange, and the back edge portion of a further one of the flanges disposed below the selected flange, the second clip portions being connected to the first clip portion to grip, in combination therewith, the core, each of the second clip portions being shaped and dimensioned such that the effective depth of the elongate grooves therein decreases in the longitudinal direction of said elongate grooves.

4. The mounting bracket according to claim 2, wherein the first clip portion is shaped and dimensioned such that the effective depth of the elongate groove therein decreases to nil in the longitudinal direction of said elongate grooves.

5. The mounting bracket according to claim 3 , wherein each of the second clip portions is shaped and dimensioned such that the effective depth of the elongate grooves therein decreases to nil in the longitudinal direction of said elongate grooves.

6. The mounting bracket according to claim 1, wherein one of said second clip portions is adapted to receive said other flange longitudinally adjacent to the selected flange and wherein the other of said second clip portions is adapted to receive said further flange longitudinally adjacent to the selected flange.

7. The mounting bracket according to claim 1, wherein the mounting panel portion is rigidly connected to the first clip portion and adapted to be secured to a vehicle frame.

8. The mounting bracket according to claim 7, wherein the mounting panel portion is adapted to project laterally beyond the selected flange.

9. The mounting bracket according to claim 7, wherein the first clip portion and the panel portion together define an elongate bridge structure, each defining one end of the bridge structure, and wherein the elongate groove of the first clip portion runs longitudinally relative to the bridge structure, and terminates at the end thereof defined by the first clip portion.

10. The mounting bracket according to claim 9, wherein the pair of leg portions are disposed in spaced-apart relation to one another, each leg portion rigidly extending between the bridge structure and a respective second clip portion.

11. The mounting bracket according to claim 10, wherein the leg portions have contacting parts which are adapted to be disposed in overlapping relation, respectively, against a surface of the other flange and against a surface of the further flange.

12. A mounting bracket for a heat exchanger core of the type having a tubular manifold disposed about a primary axis, said manifold being formed of a plurality of tubular manifold segments and having top and bottom ends spaced apart in the direction of the primary axis, inner and outer sides spaced apart in the direction of a secondary axis perpendicular to the primary axis, and front and back sides spaced apart in the direction of a tertiary axis perpendicular to the primary and secondary axes; a plurality of fluid tubes arranged in substantially parallel, spaced-apart relation, each tube extending inwardly from a respective manifold segment, and extending therefrom substantially parallel to the secondary axis; and each tube having a respective peripheral flange with front and rear portions adjacent to the respective front and back sides of each respective manifold segment, each flange having a pair of laterally extending front and back edge portions spaced-apart from one another in the direction of the tertiary axis;

said mounting bracket comprising:

a first clip portion having an elongate groove formed therein extending in the direction of the secondary axis and adapted to grippingly engage the front edge portion of a selected flange;

a mounting panel portion rigidly connected to the first clip portion and extending from one distal end of the first clip portion also in the direction of the secondary axis;

the first clip portion and the panel portion together defining an elongate bridge structure, each defining one end of the bridge structure, and wherein the elongate groove of the first clip portion runs longitudinally relative to the bridge structure, and terminates at the end thereof defined by the first clip portion;

a pair of second clip portions each having a respective elongate groove formed therein, said second clip portions being adapted to grippingly engage, respectively, the back edge portion of an other one of the flanges disposed above the selected flange, and the back edge portion of a further one of the flanges disposed below the selected flange, the second clip portions being connected to the first clip portion to grip, in combination therewith, the core; wherein the pair of second clip portions are rigidly connected to the first clip portion by a pair of leg portions, disposed in spaced-apart relation to one another, each leg portion rigidly extending between the mounting panel portion and a respective second clip portion; and a pair of abutment ear portions extending away from one another, each from a respective leg portion and in substantially transverse relation thereto, the ear portions being adapted to engage, respectively, the outer edge portions of each of the other flange and the further flange.

13. A mounting bracket for a heat exchanger core of the type having a tubular manifold disposed about a primary axis, said manifold being formed of a plurality of tubular manifold segments and having top and bottom ends spaced apart in the direction of the primary axis, inner and outer sides spaced apart in the direction of a secondary axis perpendicular to the primary axis, and front and back sides spaced apart in the direction of a tertiary axis perpendicular to the primary and secondary axes; a plurality of fluid tubes arranged in substantially parallel, spaced-apart relation, each tube extending inwardly from a respective manifold segment, and extending therefrom substantially parallel to the secondary axis; and each tube having a respective peripheral flange with front and rear portions adjacent to the respective front and back sides of each respective manifold segment, each flange having a pair of laterally extending front and back edge portions spaced-apart from one another in the direction of the tertiary axis;

said mounting bracket comprising:

a first clip portion having an elongate groove formed therein extending in the direction of the secondary axis and adapted to grippingly engage the front edge portion of a selected flange;

a mounting panel portion rigidly connected to the first clip portion and extending longitudinally from one distal end of the first clip portion also in the direction of the secondary axis;

the first cup portion and the panel portion together defining an elongate bridge structure, each defining one end of the bridge structure, and wherein the elongate groove of the first clip portion runs longitudinally relative to the bridge structure, and terminates at the end thereof defined by the first clip portion;

a pair of second clip portions each having a respective elongate groove formed therein, said second clip portions being adapted to grippingly engage, respectively, the back edge portion of an other one of the flanges disposed above the selected flange, and the back edge portion of a further one of the flanges disposed below the selected flange, the second clip portions being connected to the first clip portion to grip, in combination therewith, the core; wherein the pair of second clip portions are rigidly connected to the first clip portion by a pair of leg portions, disposed in spaced-apart relation to one another, each leg portion rigidly extending between the mounting panel portion and a respective second clip portion; and a pair of abutment ear portions extending towards one another, each from a respective leg portion and in substantially transverse relation thereto, the ear portions being adapted to engage, respectively, the outer edge portions of each of the other flange and the further flange.

14. A mounting bracket for a heat exchanger core of the type having a tubular manifold disposed about a primary axis, said manifold being formed of a plurality of tubular manifold segments and having top and bottom ends spaced apart in the direction of the primary axis, inner and outer sides spaced apart in the direction of a secondary axis perpendicular to the primary axis, and front and back sides spaced apart in the direction of a tertiary axis perpendicular to the primary and secondary axes; a plurality of fluid tubes arranged in substantially parallel, spaced-apart relation, each tube extending inwardly from a respective manifold segment, and extending therefrom substantially parallel to the secondary axis; and each tube having a respective peripheral flange with front and rear portions adjacent to the respective front and back sides of each respective manifold segment, each flange having a pair of laterally extending front and back edge portions spaced-apart from one another in the direction of the tertiary axis;

said mounting bracket comprising:

a first clip portion having an elongate, tapered groove formed therein adapted to grippingly engage the front edge portion of a selected flange; and a pair of second clip portions each having a respective elongate groove formed therein, said second clip portions being adapted to grippingly engage, respectively, the back edge portion of an other one of the flanges disposed above the selected flange, and the back edge portion of a further one of the flanges disposed below the selected flange, the second clip portions being connected to the first clip portion to grip, in combination therewith, the core; and wherein the second clip portions are longer than the first clip portion.

15. The mounting bracket according to claim 2, wherein each of the second clip portions is tapered such that the effective depth of the elongate grooves therein decreases in the longitudinal direction of said elongate grooves.

16. The mounting bracket according to claim 15, wherein the first clip portion is shaped and dimensioned such that the effective depth of the elongate groove therein decreases to nil in the longitudinal direction of said elongate groove.

17. The mounting bracket according to claim 16, wherein each of the second clip portions is shaped and dimensioned such that the effective depth of the elongate grooves therein decreases to nil in the longitudinal direction of said elongate grooves.

18. The mounting bracket according to claim 17, wherein one of said second clip portions is adapted to receive said other flange longitudinally adjacent to the selected flange and wherein the other of said second clip portions is adapted to receive said further flange longitudinally adjacent to the selected flange.

19. The mounting bracket according to claim 18, wherein the mounting panel portion is rigidly connected to the first clip portion and adapted to be secured to a vehicle frame.

20. The mounting bracket according to claim 9 wherein the second clip portions each extend parallel to the bridge structure and are longer in length than the first clip portion.

* * * * *